US007225723B2

(12) United States Patent
Yoon

(10) Patent No.: US 7,225,723 B2
(45) Date of Patent: Jun. 5, 2007

(54) HERMETIC COMPRESSOR

(75) Inventor: Yong Tae Yoon, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 11/341,689

(22) Filed: Jan. 30, 2006

(65) Prior Publication Data

US 2007/0028763 A1 Feb. 8, 2007

(30) Foreign Application Priority Data

Aug. 6, 2005 (KR) ..... 10-2005-0072028

(51) Int. Cl.
*F01B 9/00* (2006.01)

(52) U.S. Cl. ..... 92/140; 417/415

(58) Field of Classification Search ..... 92/140, 92/72, 74, 76; 417/415, 579 E
See application file for complete search history.

(56) References Cited

U.S. PATENT DOCUMENTS 2,668,004 A * 2/1954 Browne ..... 417/415
4,718,830 A * 1/1988 Middleton et al. ..... 417/415
6,948,418 B2 * 9/2005 Kim ..... 92/140

FOREIGN PATENT DOCUMENTS

KR 20-1999-0030045 7/1999
KR 20-2000-0001668 1/2000

* cited by examiner

*Primary Examiner*—Igor Kershteyn
(74) *Attorney, Agent, or Firm*—Blank Rome LLP

(57) ABSTRACT

A hermetic compressor capable of appropriately injecting oil from an eccentric unit of a rotating shaft in accordance with amounts required by respective regions. The hermetic compressor comprises a compression chamber in which a refrigerant is compressed, a piston to compress the refrigerant in the compression chamber, a rotating shaft to provide a drive force to advance or retreat the piston in the compression chamber, the rotating shaft having an oil path formed therein, a hollow eccentric unit to eccentrically rotate as the rotating shaft rotates, a bushing coupled to the eccentric unit and having a closed surface to close an opening of the eccentric unit, and an oil injection port formed at the bushing to determine an injection direction and injection degree of oil injected along an inner peripheral surface of the eccentric unit.

8 Claims, 9 Drawing Sheets

HERMETIC COMPRESSOR

CROSS-REFERENCE TO RELATED APPLICATION

This application claims the benefit of Korean Patent Application No. 2005-72028, filed on Aug. 6, 2005 in the Korean Intellectual Property Office, the disclosure of which is incorporated herein by reference in its entirety.

FIELD OF THE INVENTION

The present invention relates to a hermetic compressor, and, more particularly, to a hermetic compressor capable of appropriately injecting oil from an eccentric unit of a rotating shaft in accordance with amounts required by respective regions.

BACKGROUND OF THE INVENTION

Referring to FIG. 1, a conventional hermetic compressor is illustrated in sectional view. The hermetic compressor is a device to suction, compress, and discharge a refrigerant under a hermetic atmosphere, and includes a compression unit 10 to compress the refrigerant, and a drive unit 20 to drive the compression unit 10.

The compression unit 10 is arranged in a hermetic container 1 that defines a hermetic space therein. The compression unit 10 includes a frame 11, a cylinder block 12 that is integrally formed with the frame 11 and has a compression chamber 12*a* defined therein, a piston 13 that reciprocates in the compression chamber 12*a*, and a cylinder head 14 that is coupled to a side of the cylinder block 12 and has a suction chamber 14*a* and a discharge chamber 14*b*, which is open to the outside.

The drive unit 20 includes a stator 21 that produces a magnetic field, a rotor 22 that rotates by electromagnetic interaction with the stator 21, and a rotating shaft 23 press fitted in a hollow portion of the rotor 22 to rotate along with the rotor 22.

An eccentric unit 24 is provided on the top of the rotating shaft 23, and in turn, a bushing 26 is inserted on the eccentric unit 24. The bushing 26 is integrally formed with a connecting rod 28 to connect the rotating shaft 23 with the connecting rod 28, to convert the rotating motion of the rotating shaft 23 into a linear reciprocating motion of the piston 13. The rotating shaft 23 has an oil path 23*a* defined therein to supply oil to the compression unit 10 and the drive unit 20. When the rotor 22 rotates via interaction with the stator 21 a magnetic field is produced and the oil stored in a bottom region of the hermetic container 1 will be suctioned into the oil path 23*a* by a centrifugal force generated by rotation of the rotating shaft 23. The suctioned oil is then injected into the compression unit 10 via the eccentric unit 24 provided on the top of the rotating shaft 23.

The eccentric unit 24, having a hollow cylindrical shape, is eccentrically aligned with the rotating shaft 23, so that different centrifugal forces are applied to respective portions of the eccentric unit 24 during rotation of the rotating shaft 23. For example, the largest centrifugal force is applied to a portion 26 of the eccentric unit 24 located at a farthermost distance from a center axis of the rotating shaft 23. Thus, the oil, suctioned through the oil path 23*a*, is injected along an inner peripheral surface of the eccentric unit 24 in the same direction that the largest centrifugal force is applied. At maximum rotation of the piston 13 as it advances in the compression chamber 12*a* in accordance with rotation of the rotating shaft 23, the largest centrifugal force is applied to the eccentric unit 24 in a direction toward the piston 13, and thus, the oil from the eccentric unit 24 is injected into the piston 13.

The oil, injected into the piston 13, adheres to an outer peripheral surface of the piston 13, and thus, is introduced into the cylinder block 12. Consequently, a certain interior volume of the cylinder block 12 is occupied by the introduced oil. However, this is problematic because a decreased amount of gaseous refrigerant is introduced into the cylinder block 12 due to the amount of the introduced oil, resulting in degradation of compression capability. Also, the conventional hermetic compressor has no ability to determine an injection direction or injection degree of oil from the eccentric unit 24 of the rotating shaft 23. Thus, a large amount of oil may be injected into a region that requires only a slight amount of oil, or a small amount of oil may be injected into a region that requires a large amount of oil. This results in degradation in operational efficiency of the compressor.

SUMMARY OF THE INVENTION

Therefore, the present invention provides a hermetic compressor capable of determining an injection direction and injection degree of oil from an eccentric unit of a rotating shaft, thereby appropriately injecting oil in accordance with the amounts required by respective regions.

In accordance with one aspect, the present invention provides a hermetic compressor comprising a compression chamber in which a refrigerant is compressed; a piston that compresses the refrigerant in the compression chamber; a rotating shaft that provides a drive force to advance or retreat the piston in the compression chamber, and the rotating shaft having an oil path defined therein; a hollow eccentric unit to eccentrically rotate as the rotating shaft rotates; a bushing coupled to the eccentric unit that has a closed surface to close an opening of the eccentric unit; and an oil injection port formed in the bushing to determine an injection direction and injection degree of oil injected along an inner peripheral surface of the eccentric unit.

The oil injection port may be formed by cutting a part of the closed surface of the bushing. The oil injection port may be formed to face a region of the compressor experiencing high friction during operation of the compressor.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
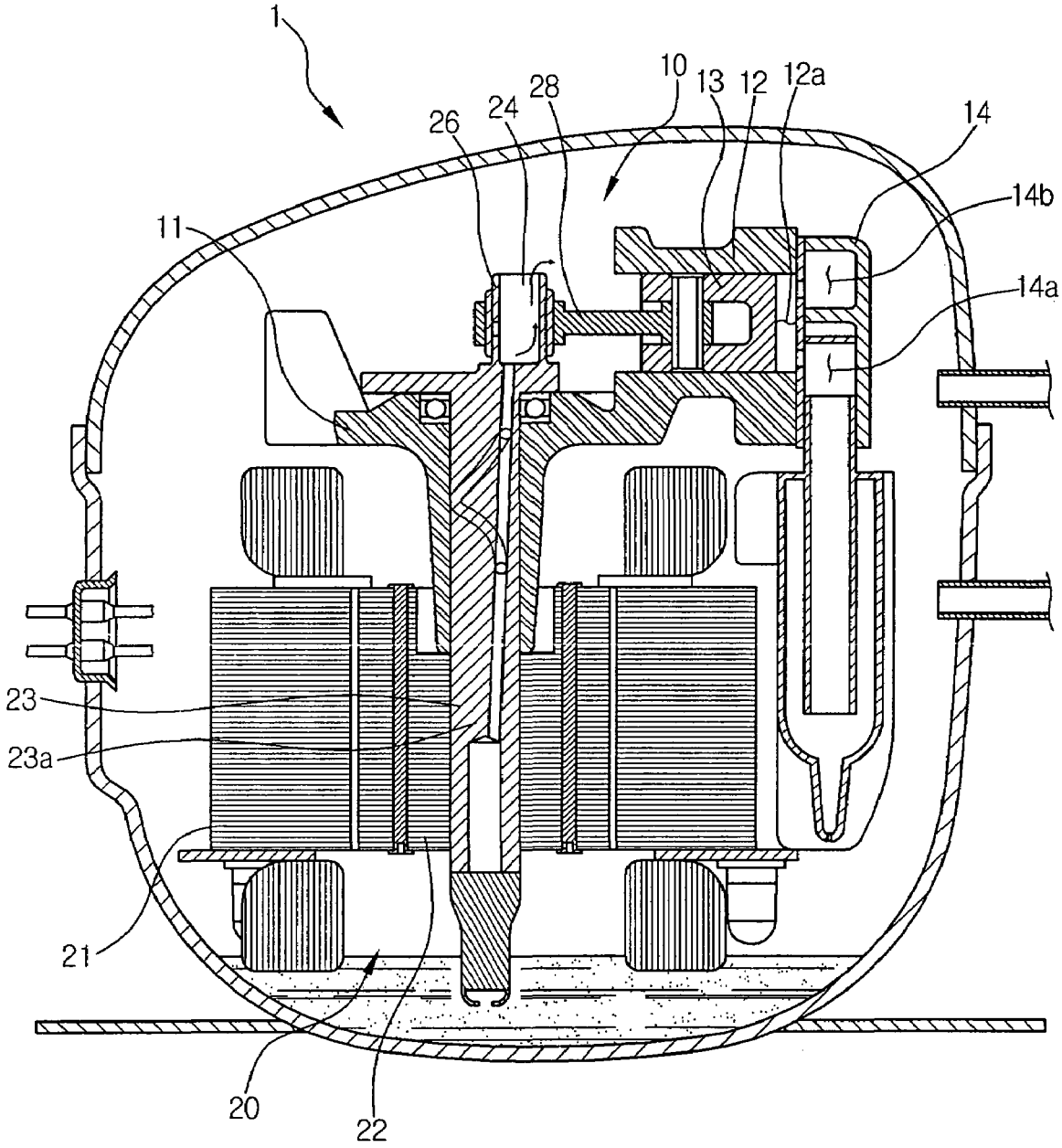
FIG.1 PRIOR ART
FIG. 1 is an elevational view of a conventional hermetic compressor taken in section.

Reference will now be made in detail to a hermetic compressor according to a preferred embodiment of the present invention, examples of which are illustrated in the accompanying drawings, wherein like reference numerals refer to like elements throughout. The embodiment is described below to explain the present invention by referring to the figures.

Figure 2:
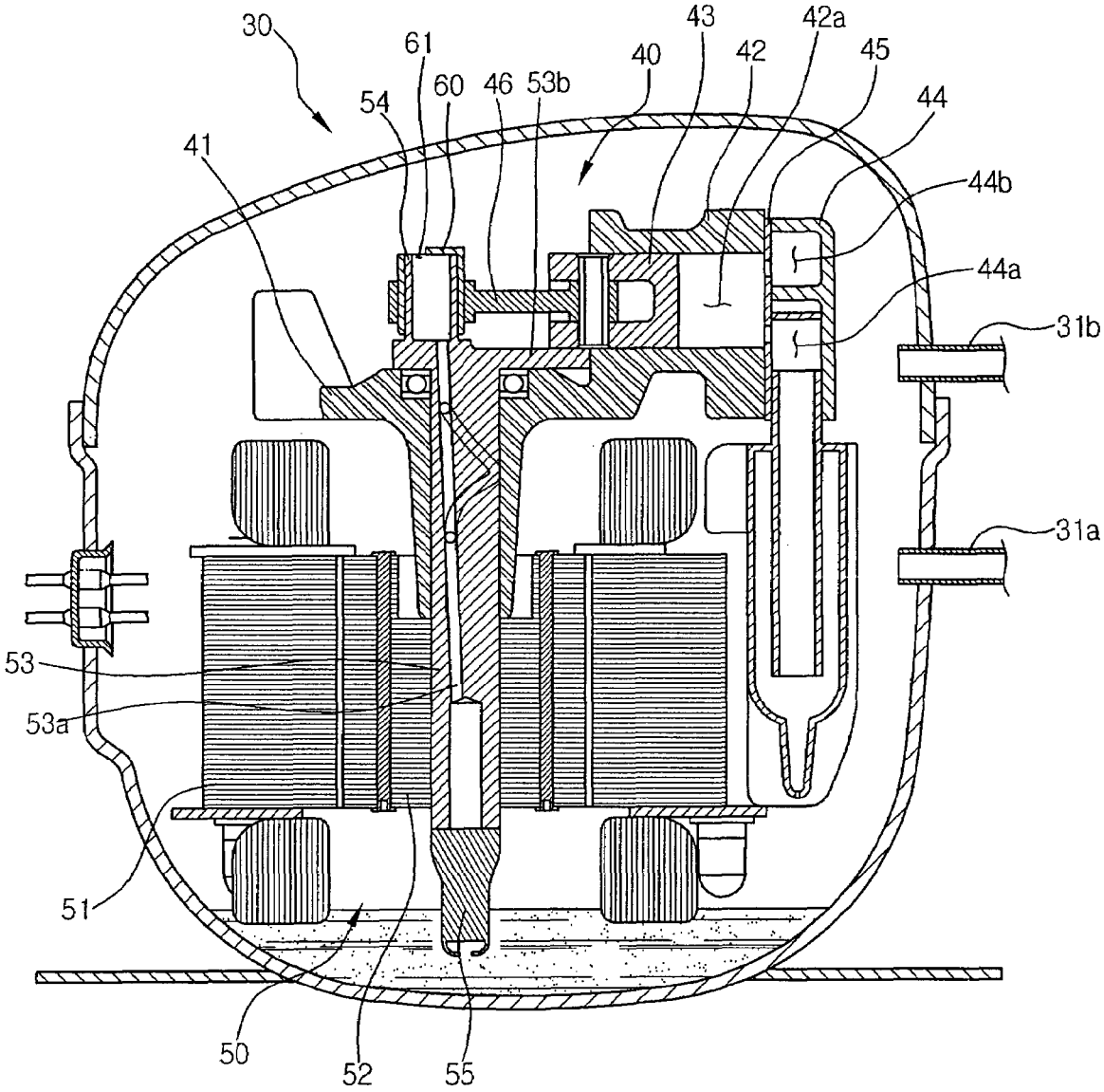
FIG. 2 is an elevational view of a hermetic compressor according to the present invention.

Referring to FIG. 2, a hermetic compressor according to an embodiment of the present invention is illustrated in sectional view. The hermetic compressor includes a compression unit 40 arranged in a hermetic container 30, which defines a hermetic space therein, to compress a refrigerant, and a drive unit 50 to drive the compression unit 40. The hermetic container 30 is provided at different positions thereof with a suction pipe 31*a* to introduce a refrigerant from an external station into the hermetic container 30 and a discharge pipe 31*b* to discharge a compressed refrigerant from the compression unit 40 to outside of the hermetic container 30.

The compression unit 40 includes a frame 41, a cylinder block 42, a piston 43, a cylinder head 44, and a valve device 45. The cylinder block 42 is arranged on the top of the frame 41 at a lateral position, and has a compression chamber 42*a* defined therein. The piston 43 is adapted to linearly reciprocate in the compression chamber 42*a* to compress a refrigerant. The cylinder head 44 is coupled to a side of the cylinder block 42 to seal the compression chamber 42*a*, and has a suction chamber 44*a* and a discharge chamber 44*b*, which are separated from each other. The valve device 45 is interposed between the cylinder block 42 and the cylinder head 44 to control flow of the refrigerant, which is introduced from the suction chamber 44*a* into the compression chamber 42*a* or is discharged from the compression chamber 42*a* into the discharge chamber 44*b*.

The drive unit 50 serves to reciprocate the piston 43 for compressing a refrigerant in the compression unit 40. The drive unit 50 includes a stator 51 to produce a magnetic field, and a rotor 52 radially spaced apart from an inner periphery of the stator 51 and electromagnetically interacts with the stator 51. A rotating shaft 53 is press fitted in the center of the rotor 52 to rotate with the rotor 52 within the frame 41. At an upper end of the rotating shaft 53 is formed an eccentric unit 54 having an open upper surface, to transmit a rotational force of the rotating shaft 53 to the compression unit 40. Also, a weight 53*b* is formed at the upper end of the rotating shaft 53 opposite to the eccentric unit 54, to prevent the rotating shaft 53 from tilting due to the eccentric unit 54 during rotation thereof. A bushing 60 is inserted on an outer periphery of the eccentric unit 40 to convert the rotating motion of the rotating shaft 53 into a linear reciprocating motion of a connecting rod 46.

The rotating shaft 53 has an elongated oil path 53*a* axially extending therein. An oil suction tube 55 is provided at a lower end of the rotating shaft 53 to suction oil stored in a bottom region of the hermetic container 30 to an upper position of the rotating shaft 53 via the oil path 53*a*.

Application of electric current to the hermetic compressor having the above configuration, rotates the rotor 52 via interaction with the stator 51 that produces a magnetic field, and simultaneously, the oil is suctioned from the oil suction tube 55 provided at the lower end of the rotating shaft 53. The suctioned oil is injected from the hollow cylindrical eccentric unit 54 located on the upper end of the rotating shaft 53.

Figure 3:
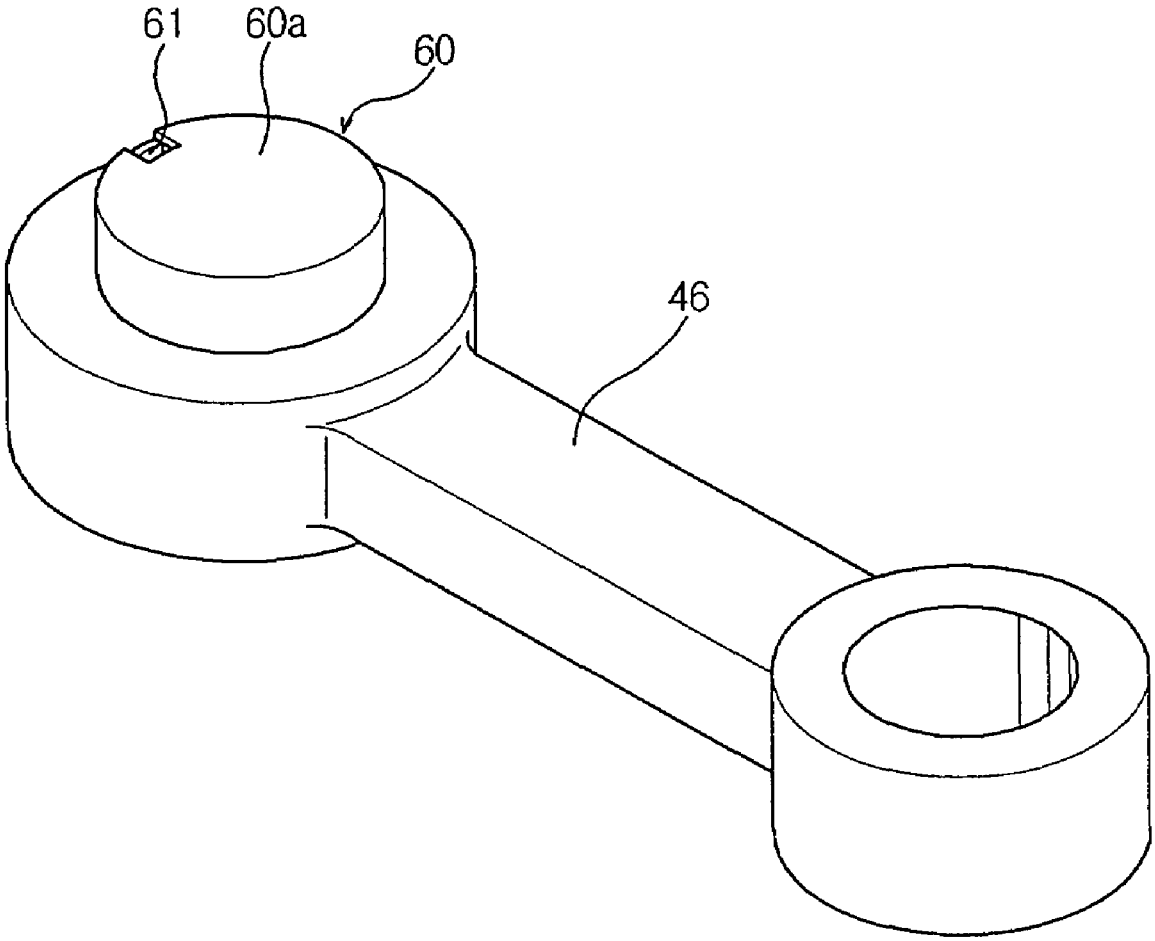
FIG. 3 is a perspective view of a bushing according to a first embodiment of the present invention.

The bushing 60 is inserted and coupled on the eccentric unit 54 to determine an injection direction of the oil from the eccentric unit 54 of the rotating shaft 53. Referring to FIG. 3, the bushing 60 according to a first embodiment of the present invention is illustrated.

As shown in FIG. 3, the bushing 60 of the first embodiment generally has a cylindrical shape, and has a closed upper surface 60*a*. The closed upper surface 60*a* is partially cut to form an oil injection port 61 having a hole shape. The oil injection port 61 is located at the farthermost distance from the piston 43 (FIG. 4) that is coupled to the connecting rod 46.

In the hermetic compressor having the above configuration, the oil is suctioned up to the eccentric unit 54 of the rotating shaft 53 in accordance with rotation of the rotating shaft 53, and passes along an inner peripheral surface of the eccentric unit 54 in a direction that the largest centrifugal force is applied.

Figure 4:
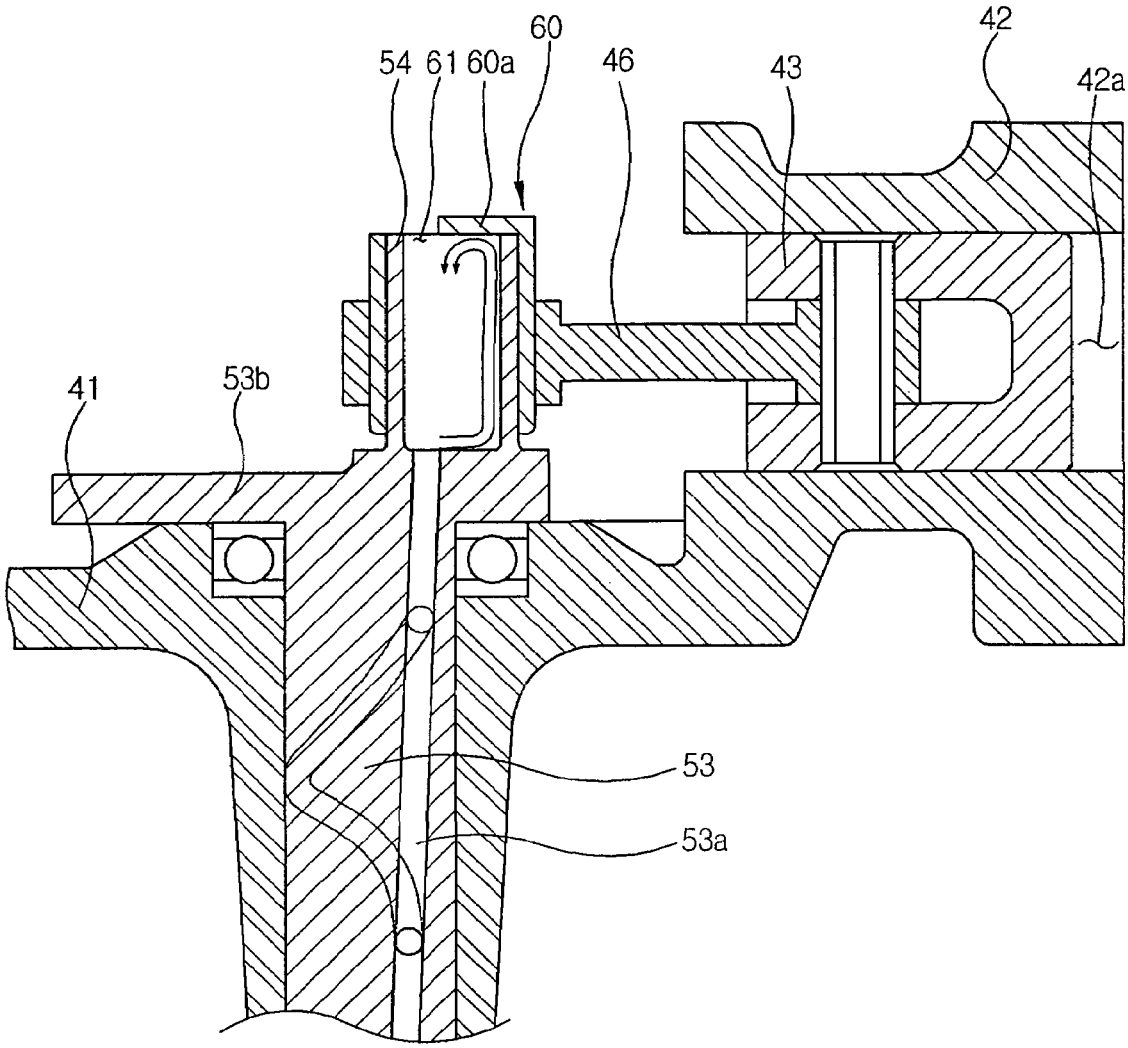
FIG. 4 is an enlarged, partial, elevational view of the hermetic compressor taken in section, showing an oil injection direction when a piston advances in a compression chamber to the maximum extent.
Figure 5:
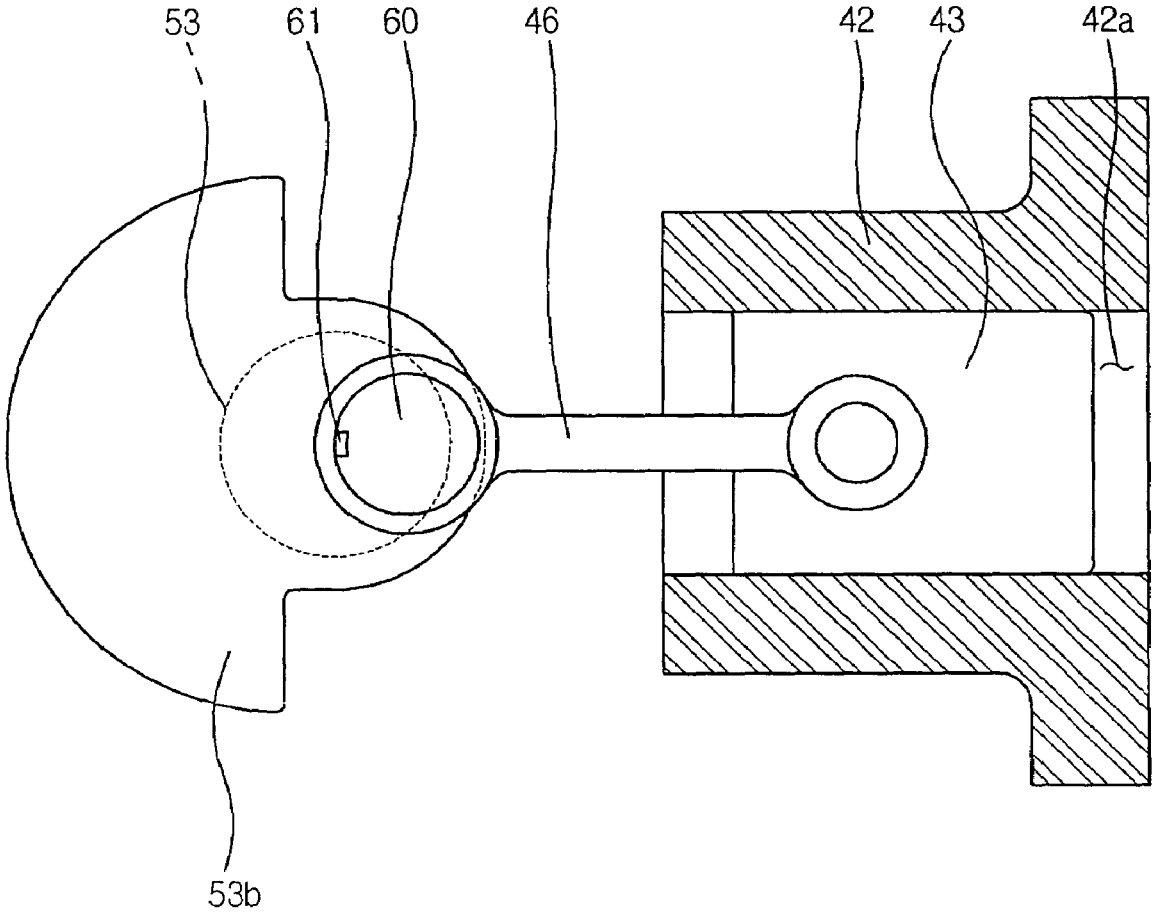
FIG. 5 is an enlarged plan view of the piston taken in section, showing the position of an oil injection port when the piston advances in the compression chamber to the maximum extent.

As shown in FIGS. 4 and 5, when the piston 43 advances in the compression chamber 42*a* in accordance with rotation of the rotating shaft 53, the largest centrifugal force is applied to a portion of the inner peripheral surface of the eccentric unit 54 located at the farthermost distance from a center axis of the rotating shaft 53, so that the oil is raised along a portion of the inner peripheral surface of the eccentric unit 54 closest to the piston 43. In this case, since a final arrival position of the oil is closed by the closed upper surface 60*a* of the bushing 60, it is impossible to inject the oil into the outside of the bushing 60.

Figure 6:
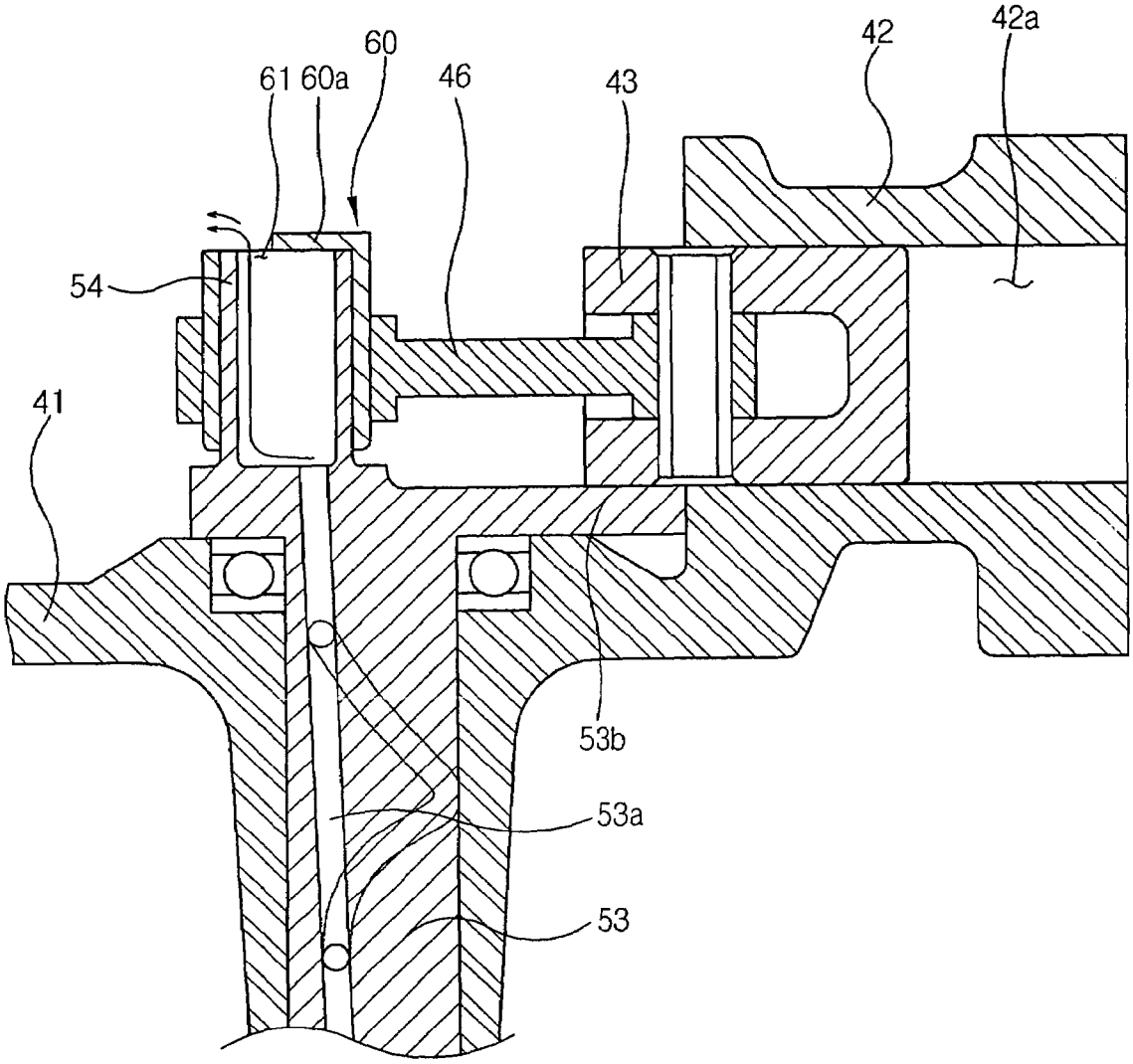
FIG. 6 is an enlarged, partial, elevational view of the hermetic compressor taken in section, showing an oil injection direction when the piston retreats in the compression chamber to the maximum extent.
Figure 7:
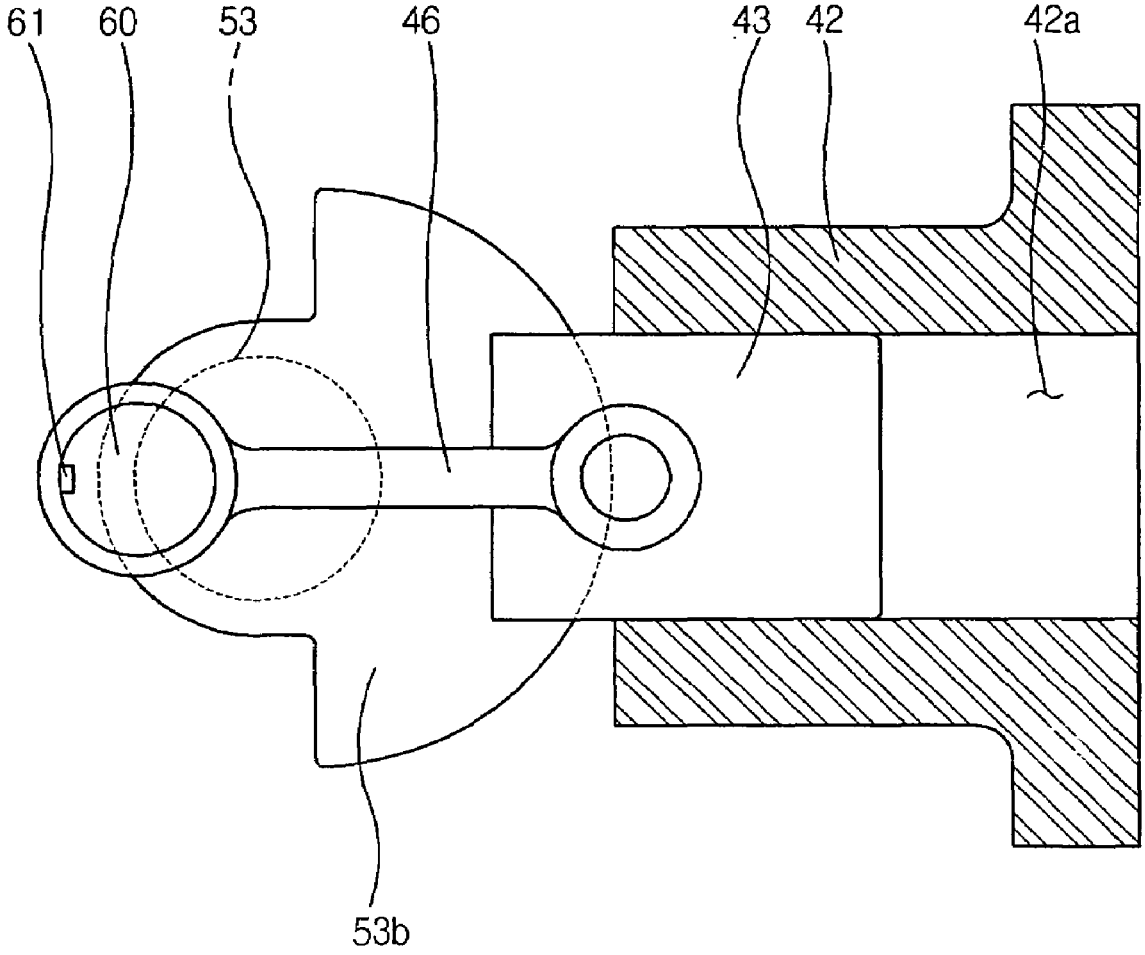
FIG. 7 is an enlarged plan view of the piston taken in section, showing the position of the oil injection port when the piston retreats in a compression chamber to the maximum extent.

However, as shown in FIGS. 6 and 7, when the piston 43 retreats in the compression chamber 42*a* in accordance with rotation of the rotating shaft 53, the largest centrifugal force is applied to a portion of the inner peripheral surface of the eccentric unit 54 located at a farthermost distance from the center axis of the rotating shaft 53, so that the oil is raised along a portion of the inner peripheral surface of the eccentric unit 54 located at the farthermost distance from the piston 43. Since the oil injection port 61 is located at an upper side of the farthermost portion, the oil can be injected via the oil injection port 61. The oil is injected via a small hole shape, in the oil injection port 61, thereby sending concentrated oil into a direction opposite the piston 43 because the oil injection port 61 is located at the farthermost distance from the piston 43. Thus, the oil will not substantially adhered to the piston 43.

As stated above, by providing the bushing 60 with the closed upper surface 60*a* and cutting part of the closed upper surface 61*a* to form the oil injection port 61, an injection direction and injection degree of oil can be determined.

It should be understood that the position of the oil injection port 61 is not limited to the position at the farthermost distance from the piston 43. For example, the oil injection port 61 may be formed to face a specific region of the compressor experiencing high abrasion during operation of the compressor, to inject a large amount of oil to the high abrasion region, thereby reducing the degree of abrasion.

Figure 8:
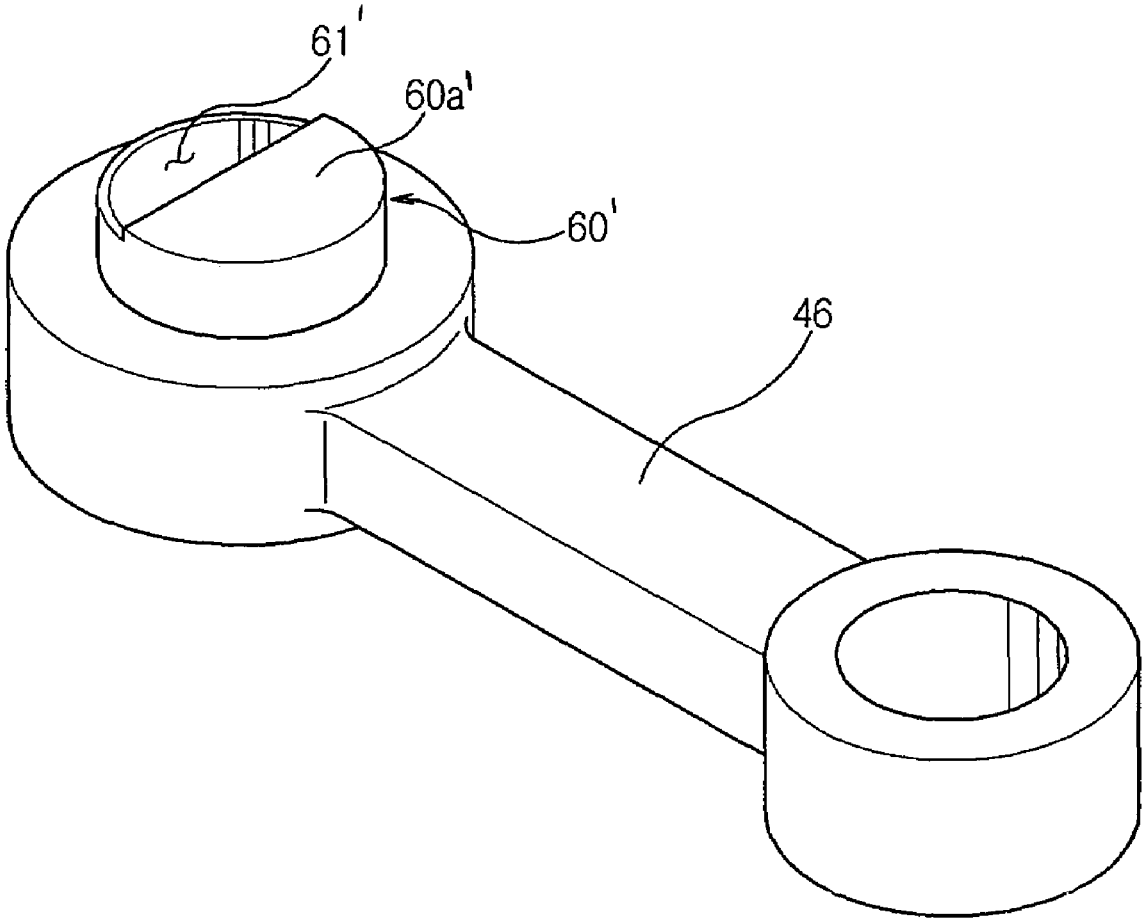
FIG. 8 is a perspective view of a bushing according to a second embodiment of the present invention.

Referring to FIG. 8, a bushing 60' according to a second embodiment of the present invention is illustrated. The bushing 60' has an oil injection port 61', which occupies about one-third to one half of a closed upper surface 60*a*', to more widely distribute the oil as compared to the bushing 60 of the first embodiment.

Figure 9:
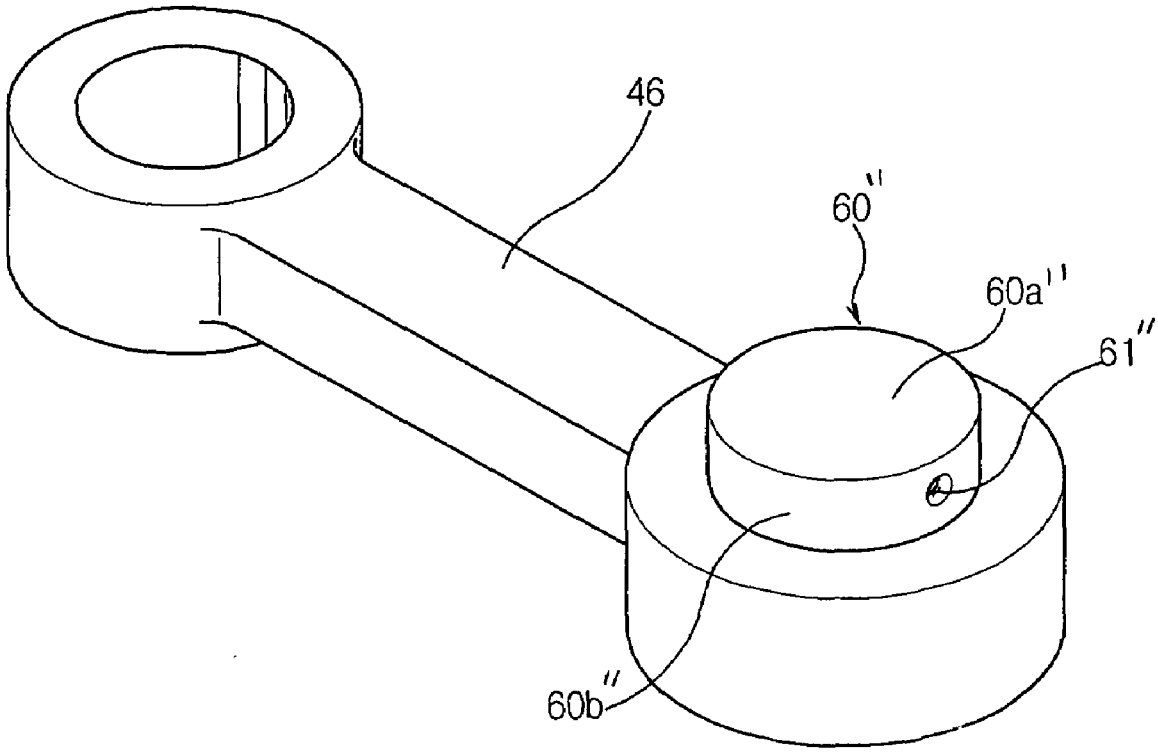
FIG. 9 is a perspective view of a bushing according to a third embodiment of the present invention.

Referring to FIG. 9, a bushing 60" according to a third embodiment of the present invention is illustrated. The bushing 60" has an oil injection port 61", which is a hole formed at a circumferential wall surface 60*b*" of the bushing 60" rather than being formed at a closed upper surface 60*a*" of the bushing 60", so that the oil can be concentrated and injected in a horizontal direction as compared to the bushing 60 of the first embodiment. In this manner, by providing the bushing with the closed upper surface to close the eccentric unit 54 of the rotating shaft 53 and changing the size and position of the oil injection port, the injection direction and injection degree of the oil can be determined.

As apparent from the above description, the present invention provides a hermetic compressor capable of determining an injection direction and injection degree of oil from an eccentric unit of a rotating shaft, thereby appropriately injecting oil in accordance with amounts required by respective regions. This effectively prevents degradation in compressor efficiency.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A hermetic compressor comprising:

a compression chamber adapted to compress a refrigerant;

a piston disposed in the compression chamber;

a rotating shaft driving the piston in the compression chamber between advance and retreat positions, the rotating shaft having an oil path defined therein and a hollow eccentric unit that eccentrically rotates as the rotating shaft rotates;

a bushing coupled to the eccentric unit and having a closed surface to close an opening of the eccentric unit; and an oil injection port formed in the bushing adapted to determine an injection direction and injection degree of oil injected along an inner peripheral surface of the eccentric unit.

2. The compressor according to claim 1, wherein the oil injection port is formed by cutting a part of the closed surface of the bushing.

3. The compressor according to claim 2, wherein the oil injection port is located at a farthermost distance from the piston.

4. The compressor according to claim 3, wherein the oil injection port is formed by cutting one-third to one half of the closed surface.

5. The compressor according to claim 1, wherein the oil injection port is formed at a circumferential wall surface of the bushing.

6. The compressor according to claim 1, wherein the oil injection port faces a region of the hermetic compressor experiencing high friction during operation thereof.

7. The compressor according to claim 1, wherein the bushing is integrally formed with a connecting rod that connects the piston to the eccentric unit.

8. The compressor according to claim 1, wherein the oil injection port is a small hole formed in the bushing.

* * * * *